United States Patent [19]

Precoul

[11] 4,170,940

[45] Oct. 16, 1979

[54] PROJECTILE CHARGES

[75] Inventor: Michel Precoul, Paris, France

[73] Assignee: Societe d'Etudes, de Realisations et d'Applications Techniques, Paris, France

[21] Appl. No.: 813,694

[22] Filed: Jul. 7, 1977

[30] Foreign Application Priority Data

Sep. 27, 1976 [FR] France ..... 76 28964

[51] Int. Cl.[2] ..... F42B 1/02

[52] U.S. Cl. ..... 102/56 SC

[58] Field of Search ..... 102/56 SC, 56 R, 24 HC, 102/24 R

[56] References Cited

U.S. PATENT DOCUMENTS

| | | | |
|---|---|---|---|
| 1,844,701 | 2/1932 | Tama | 86/20 |
| 2,897,714 | 8/1959 | Precoul | 86/20 |
| 2,900,905 | 8/1959 | MacDougall | 102/56 SC |
| 2,990,683 | 7/1961 | Walden | 102/202 |
| 3,082,689 | 3/1963 | Griffith et al. | 102/24 R |
| 3,192,289 | 6/1965 | Jagiello | 86/20 |
| 3,557,656 | 1/1971 | Precoul | 86/31 |
| 3,561,361 | 2/1971 | Kessenich et al. | 102/24 HC |
| 3,796,158 | 3/1974 | Conger | 102/56 R |
| 3,796,159 | 3/1974 | Conger | 102/56 R |
| 3,865,035 | 2/1975 | Munson et al. | 102/56 R |
| 3,985,077 | 10/1976 | Conger et al. | 102/56 R |

*Primary Examiner*—Charles T. Jordan

*Attorney, Agent, or Firm*—Davis, Hoxie, Faithfull & Hapgood

[57] ABSTRACT

Charge for an explosive projectile characterized in that it comprises a plurality of adjacent, coaxial and annular layers, the peripheral layer having a higher content of heavy powerful explosive than the immediately adjacent layer and so on to the central axial layer which is a solid cylinder and has the lowest content of heavy powerful explosive.

1 Claim, 3 Drawing Figures

PROJECTILE CHARGES

The present invention concerns improvements relating to projectile charges.

The present-day conventional charges (particularly for shaped charge projectiles) are those introduced by pouring and based on tolite containing, in suspension, heavy powerful explosives such as pentrite, hexogene and octogene. By various means such as for example the shape, dimensions and proportions of the projectile, the feed and heat treatment of the charge, the features of which are optimized for each particular case, the composition of the mixture, the viscosity particle-size and particle-size range of the heavy unfused explosive, etc. . . , it has become possible to obtain mixtures which are very uniform and exhibit little porosity, which are disposed symmetrically about the longitudinal axis, and which have a high content of heavy powerful explosive such as hexogene for example. These results and the steps used for achieving them have greatly contributed to improving the performance of modern shaped charges.

Furthermore, the introduction of the priming screen has made it possible to generate detonation waves of concave toroidal shape, (as seen from the nose of the projectile, the wave advancing towards the viewer). This step, combined with those mentioned above, has also contributed to an increase in the power of shaped charges which has now reached 5 calibres or more, with maxima in the order of 6 to 6.5 calibres.

All of these conventional improvements are in particular aimed at two essential classes of parameter of the shaped charge, i.e. length of the jet on the one hand, and symmetry on the other. It has long been known that the penetration power is directly related to the length of the jet which, furthermore, should be straight, continuous and symmetrical. Thus, the head of the jet, created by the nose of the casing, is sustained by the adjoining zone, whereas the tail of the jet and the "core", not participating in penetration are created by the base of the casing.

Thus, to increase the penetration power, it is necessary to lengthen the jet by causing participation of the greater fraction of the generatrix of the casing, remote from the nose, and to try to transfer, from the "core" to the jet, a greater fraction of the base of said casing.

With this end in view, the invention provides a charge characterized in that it comprises juxtaposed, annular and coaxial layers which contain progressively higher contents of heavy powerful explosive (hexogene for example) the further they are away from the axis, the detonation wave then being propagated more rapidly in the peripheral layers, and velocity being lowest at the axis and increasing progressively as the periphery is approached and as a function of the increasing content of powerful explosive, so that the wave thus also has a concave toroidal shape (as seen from the front of the casing, irrespective of whether or not a screen is present, both possibilities being covered by the invention).

In these conditions and according to the invention, the faster arrival of the detonation wave in the peripheral layers permits earlier attack on the base fractions of the casing, the particles of which join, at an earlier stage and often at an earlier stage and more intimately, the jet normally created by the tip of said casing and the neighbouring zone. Consequently, according to the invention, a lengthening of the effective jet, good continuity of the jet and a consequent increase in penetrating power are achieved.

To achieve this result and in accordance with the invention, the charge is formed by adjacent, annular, coaxial, cylindrical layers, the peripheral layer having a content of powerful heavy explosive that is greater than that of the inwardly adjacent layer as seen on the same transverse plane at right-angles to the longitudinal axis of the projectile. According to the invention, at least two coaxial layers are provided, i.e. a central layer (solid cylinder) surrounded by an annular peripheral layer.

The various features and advantages of the invention will be seen from the examples described below. These examples are however quoted simply by way of illustration, and any other forms of construction, shapes, sizes and dispositions can also be used within the framework of the invention.

The example dealt with below relates to a charge comprising two annular outer layers which surround a solid cylindrical central layer. The invention also covers any number of annular outer layers other than two.

The example dealt with below concerns a disc-shaped priming means not having a screen. However, the invention also relates to priming means of any shape, with or without a screen.

Finally, the example dealt with below concerns a projectile having a shaped charge with a conical casing. However, the invention also covers any form of casing for a shaped charge and, in addition, explosive projectile not having a shaped charge.

The following description refers to the attached drawings in which.

Figure 1:
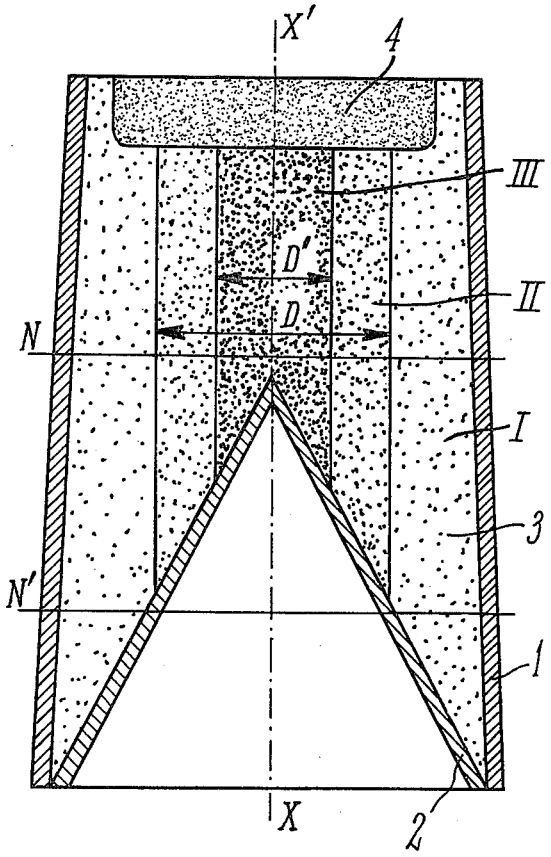
FIG. 1 is a longitudinal section through a projectile in accordance with the invention.

The projectile shown in FIG. 1 consists of a shell 1, a casing 2 for the shaped charge, an explosive charge designated as a whole by the reference number 3, and a priming means 4 (which, in the present non-limiting example, takes the form of a disc). The longitudinal axis of the projectile extends along the line X–X'.

In this embodiment of the invention, the charge 3 consists of three coaxial layers, namely:

- a central cylindrical layer III having a powerful explosive content of H,
- an annular layer II adjacent to and coaxial with III and having a powerful explosive content of $H' > H$, and
- an annular layer I (adjacent to and coaxial with the layer II), having a powerful explosive content of $H'' > H' > H$.

Still within the framework of the invention, the relative contents H, H' and H'' of powerful explosive may be constant in the same layer (this being the case with a compressed explosive containing an addition such as wax, or a composite explosive comprising a plastics binding agent).

Within the same layers the relative contents H, H' and H'' may vary (the conventional case of a poured charge having a tolite base wherein the powerful explosive content is greater at the front-zone X than at the rear end—zone X'—when charging is carried out by gravity and through the rear end).

In the first case and in accordance with the invention, $H''>H'>H$, so that the peripheral layers (I) have a lower binding agent content than the central layers (III).

In the second case and in accordance with the invention, charging is carried out in such a way that in one and the same plane N perpendicular to the longitudinal axis X-X', the contents of the various layers is in accordance with the formula $H''>H'>H$. In another plane N' located nearer the front end, the formula is $H''_1>H'_1>H_1$, though if N' is nearer the front than N, then $H''_1>H''$($H''_1$, $H'_1$ and $H_1$ being the respective contents of heavy powerful explosive in the layers I, II and III in the plane N').

Figure 2:
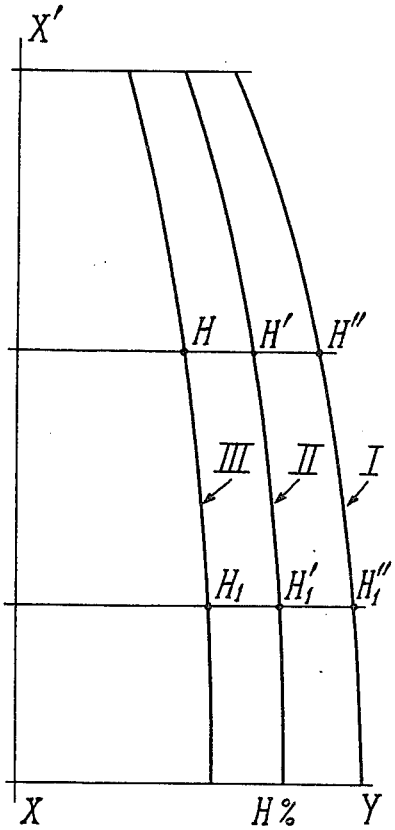
FIG. 2 illustrates diagrammatically the features of the charge for the projectile shown in FIG. 1.

FIG. 2 illustrates the distribution of the contents in heavy powerful explosive as proposed by the invention and in the projectile shown in FIG. 1 in the case of a poured charge based on tolite.

The X-Y axis shows the percentage in heavy powerful explosive H; the X-X' axis shows the various planes N along the projectile.

According to the invention, the distribution of the percentage contents H in zone I is outside the curve for the zone II, and the latter is in turn outside the curve for the zone III (each outside position indicating an increasing percentage content H).

The detonation velocities in each layer follow similar curves. The detonation wave of the charge in accordance with the invention is thus concave and toroidal as seen by a viewer positioned in front of the projectile and observing this wave advancing towards him, so that a larger fraction of the casing participates in the continuous jet as aimed at by the invention.

In the case of a compressed explosive, the charge in accordance with the invention is made up of annular or cylindrical blocks of a suitable shape and diameter which are positioned and bonded to each other to obtain the arrangement shown in FIG. 1 for example. After optimization, care is taken to distribute the explosive content so that it corresponds to the condition $H''>H'>H$ in accordance with the invention.

According to the invention, the same conditions apply in the case where a composite explosive having a plastics binding agent is used.

Figure 3:
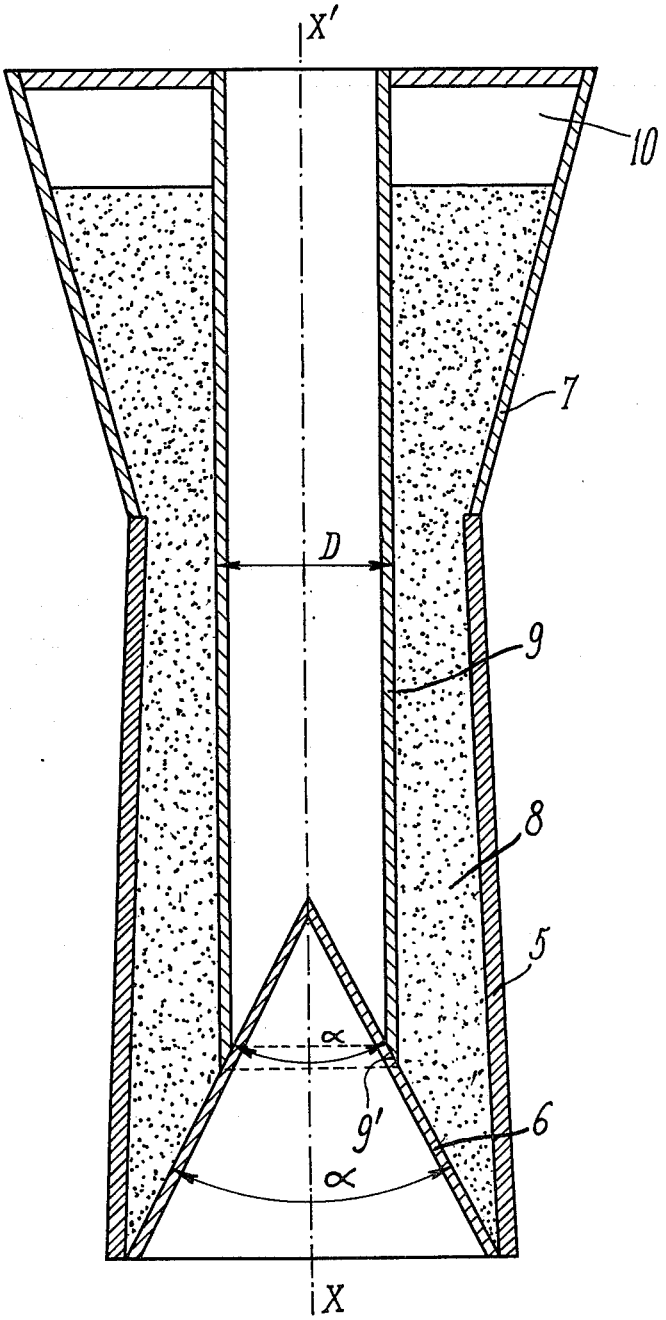
FIG. 3 is a longitudinal section showing the essential arrangement of the parts forming the charge in accordance with the invention.

In the conventional charge introduced by pouring and consisting of a mixture based on tolite, the improvements in accordance with the invention are achieved for example in the manner described below by reference to FIG. 3. The projectile comprises a shell 5 and a casing 6 (which is conical and has a cone angle of $\alpha$ for example). A charging funnel 7 is fitted in a manner not illustrated.

According to the invention, the peripheral annular layer 8 of explosive (having a maximum content H'') is formed by fitting in position a cylindrical tool 9, (made of metal or plastics material) having an outside diameter D corresponding to the inside diameter D of the annular peripheral layer I (FIG. 1), this tool being centered on the axis X-X' in the funnel 7 with the aid of three or more vanes 10 and by fitting the front end 9' of said tool 9 on the casing 6 so that the zone of contact between the tool and the casing constitutes a frusto-conical portion having an angle $\alpha$.

After the charge has been made up, poured in and heat treated in the usual manner, the tool 9 is lifted, and using a similar tool the second annular layer in accordance with the invention is poured into the interior. (If, for example, a charge as in FIG. 1 is used, the second tool 9 is similar but has a diameter D' instead of D). Then, in accordance with the invention, the mixture is made up to give $H'<H''$.

This procedure is repeated in stages, and the final solid, cylindrical and central layer having an explosive content of $H<H'$ (FIG. 1 for example) is poured directly into the cylindrical axial space left by the penultimate operation in accordance with the invention.

However, to obtain the charge comprising cylindrical, annular and coaxial layers in accordance with the invention, cooling in each operation is not continued to approximately 20° C. as is usual with conventional charges, but, according to the invention, is arrested within a range of approximately 50° C. to 80° C. so as to obtain the distribution and the required percentage content H in the layer on the one hand, and to maintain a solid inside channel which is left open for the purpose of accomodating the following layer, on the other. Within the framework of the invention, the best temperature is selected within the above-mentioned range to suit the particular case.

Finally, the concave wave required for the charge comprising adjacent annular layers in accordance with the invention can also be achieved by the use of explosives of different kinds such that the detonation velocity in one layer is greater than that in the immediately adjacent inner layer and so ontowards the centre. In this case, the above-mentioned formula $H''>H'>H$ is, according to the invention, replaced by the formula $W''>W'>W$, wherein W'', W' and W are the detonation velocities in the zones I, II and III respectively of FIG. 1.

What is claimed as new is:

1. A generally cylindrical hollow shaped charge for an explosive projectile comprising a generally cylindrical jacket, and an explosive charge within the jacket, the charge having a generally conical, hollow depression in the front end of the charge, the charge being in the form of a plurality of coaxial layers, the innermost layer being a solid cylinder of explosive of relatively low power, the layer overlying the innermost layer being an annular layer having an explosive content more powerful than the innermost layer, and further annular layers, each having an explosive content more powerful than that of the adjacent inner layer, the outermost annular layer having the highest explosive content, the jacket further serving to elongate the jet by causing participation of a larger fraction of the generatrix of the conical depression remote from the front end of the charge.

* * * * *